US005765620A

United States Patent [19]

Coleman

[11] Patent Number: 5,765,620

[45] Date of Patent: Jun. 16, 1998

[54] SYSTEM FOR HANGING CURTAINS FROM A VENETIAN BLIND HEADBOX

[76] Inventor: Edward A. Coleman, 55 Ballantyne Rd., Rochester, N.Y. 14623

[21] Appl. No.: 719,382

[22] Filed: Sep. 25, 1996

[51] Int. Cl.[6] ..... A47H 1/00

[52] U.S. Cl. ..... 160/89; 160/38; 160/178.1 R

[58] Field of Search ..... 160/89, 178.1 R, 160/126, 113, 330, 902, 38

[56] References Cited

U.S. PATENT DOCUMENTS

| | | | |
|---|---|---|---|
| D. 325,681 | 4/1992 | Gartemnmaier . | |
| D. 337,469 | 7/1993 | Young et al. . | |
| 3,223,146 | 12/1965 | Wessels et al. | 160/38 |
| 3,693,210 | 9/1972 | MacFarlane et al. | 160/38 X |
| 3,883,924 | 5/1975 | Grabman | 160/126 X |
| 4,114,233 | 9/1978 | Hamilton | 160/38 X |
| 4,546,809 | 10/1985 | Hadfield | 160/126 |
| 4,567,930 | 2/1986 | Fischer . | |
| 4,601,319 | 7/1986 | Georgopoulos . | |
| 4,774,878 | 10/1988 | Berlin et al. . | |
| 4,840,216 | 6/1989 | John . | |
| 4,919,185 | 4/1990 | Comeau et al. | 160/178.1 R |
| 5,188,162 | 2/1993 | Simon et al. . | |
| 5,520,235 | 5/1996 | Coleman . | |

FOREIGN PATENT DOCUMENTS 72878 12/1947 Norway .

*Primary Examiner*—David M. Purol
*Attorney, Agent, or Firm*—M. Lukacher; K. Lukacher

[57] ABSTRACT

A system for drawably hanging curtains from a venetian blind headbox mounted on a vertical surface. A tubular attachment is mountable on the headbox and has a tail section having an inner wall of substantially the same height as the height of the headbox, and a projecting lip at the lower edge of the inner wall for retaining the headbox in the attachment without requiring other mounting elements. The attachment has a hanger section having a longitudinal T-shaped slot for receiving a plurality of curtain sliders for movably hanging a first curtain therefrom. Each of a pair of removable end pieces has flanges which are matable within either end of the attachment to retain the curtain sliders in the attachment. Each of the end pieces has at least one saddle for supporting a first curtain rod for movably hanging a second curtain therefrom and a bayonet mount for receiving a second curtain rod for movably hanging a third curtain therefrom.

12 Claims, 5 Drawing Sheets

SYSTEM FOR HANGING CURTAINS FROM A VENETIAN BLIND HEADBOX

DESCRIPTION

1. Field of the Invention

The present invention relates to devices for hanging curtains, draperies, valences, and the like to cover windows or doors, more particularly to such devices to be used in combination with venetian blinds, and most particularly to such devices which are attachable to and supported by the headboxes of mounted venetian blinds.

The term "venetian blind" as used herein refers specifically to blinds regardless of material of their slats and other parts therefore and includes mini blinds which have slats made of plastic. The term "curtain" as used herein refers generically to any flexible hanging material, such as fabric or plastic, disposable as a temporary wall to separate two spaces and typically to cover an opening in a permanent wall. A "drapery" is one type of curtain, generally formed of heavy fabric, and is typically opaque. A "sheer" curtain is a type of curtain formed of very light fabric, being translucent. A "valence" is a short curtain near the top of an opening, usually disposed outside of other curtain elements to disguise the hanging or movement mechanisms of the curtains. All curtains may be fixed or drawable, although valences typically are fixed.

2. Description of the Print Art

Venetian blinds are well known in the art. A plurality of parallel slats or vanes, typically horizontally disposed, are ganged by any of various means so that they may be drawn up or let down to cover an opening in a wall such as a window or a door. Venetian blinds may have vertical slats instead of horizontal, in which case the blind is drawn horizontally across the opening. In either type, the attitude of the slats may be changed to vary the open area of the door or window. Typically, the mechanism for changing the attitude of the slats and for advancing or withdrawing the blind across the opening is contained in a generally rectangular portion of the blind at the top, known as a headbox. Generally, the headbox is supported at the ends and is a free span over most of its length. A long headbox may have one or more auxiliary supports along its length.

It is also known to use the headbox for support of attachments to permit hanging of a curtain or drapery next to and in front of the venetian blind slats. For example, in my U.S. Pat. No. 5,520,235 issued May 28, 1996 an attachment is disclosed which can be slid onto or snapped over a headbox of a venetian blind for supporting both a drawable light-weight curtain, supported by hangers in a slot, and a fixed curtain, supported by hooks along an outer surface of the attachment, simultaneously in front of the venetian blind. An adhesive strip between the attachment and the headbox prevents lateral slip of the attachment in use. In addition, left and right-handed end pieces are insertable into the respective ends of the attachment to support a conventional curved curtain rod in front of the fixed curtain.

It is a principal object of the invention to provide an improved system for hanging curtains from a venetian blind headbox wherein up to three curtains can each be drawably supported.

It is a further object of the invention to provide an improved system for hanging curtains from a headbox wherein a drapery can be supported by standard curtain slides.

It is a still further object of the invention to provide an improved system for hanging curtains from a headbox wherein a curtain can be supported by a standard cylindrical curtain rod.

It is a still further object of the invention to provide an improved system for hanging curtains from a headbox wherein a universal end cap is insertable into either end of a headbox attachment.

It is a still further object of the invention to provide an improved system for hanging curtains from a headbox wherein a headbox attachment is attachable to a headbox without the use of an adhesive strip.

SUMMARY OF THE INVENTION

Briefly described, a system embodying the present invention includes a longitudinal attachment device having a tail section with an inner surface, an outer surface, a front wall, a back wall, and an open lower portion. The open lower portion can receive the headbox of a venetian blind therein. The lower edge of the back wall is provided with a continuous lip which engages the corresponding corner of the headbox to secure the headbox within the attachment without resort to adhesives. The device may also include a polygonally tubular inner support section which provides beam support for the attachment. The device further includes a hanger section having a longitudinal T-shaped slot for receiving a plurality of standard curtain slides which can also serve to receive end caps therein for retaining of the curtain slides, the end caps having one or more curtain rod brackets thereupon. Alternatively, the end caps may be received by the ends of the polygonally tubular support section.

Thus, the device may be slid onto or snapped over a venetian blind headbox to drawably support a first curtain or set of curtains on curtain slides in the T-shaped slot; a second curtain or set of curtains on a cylindrical curtain rod supported by the inserted end caps; and a third curtain or set of curtains on a curved curtain rod also supported by the end caps, all three curtains being drawably supported.

DESCRIPTION OF THE DRAWINGS

The foregoing and other objects, features, and advantages of the invention, as well as presently preferred embodiments thereof, will become more apparent from a reading of the following description in connection with the accompanying drawings in which.

DETAILED DESCRIPTION OF THE INVENTION

Figure 1:
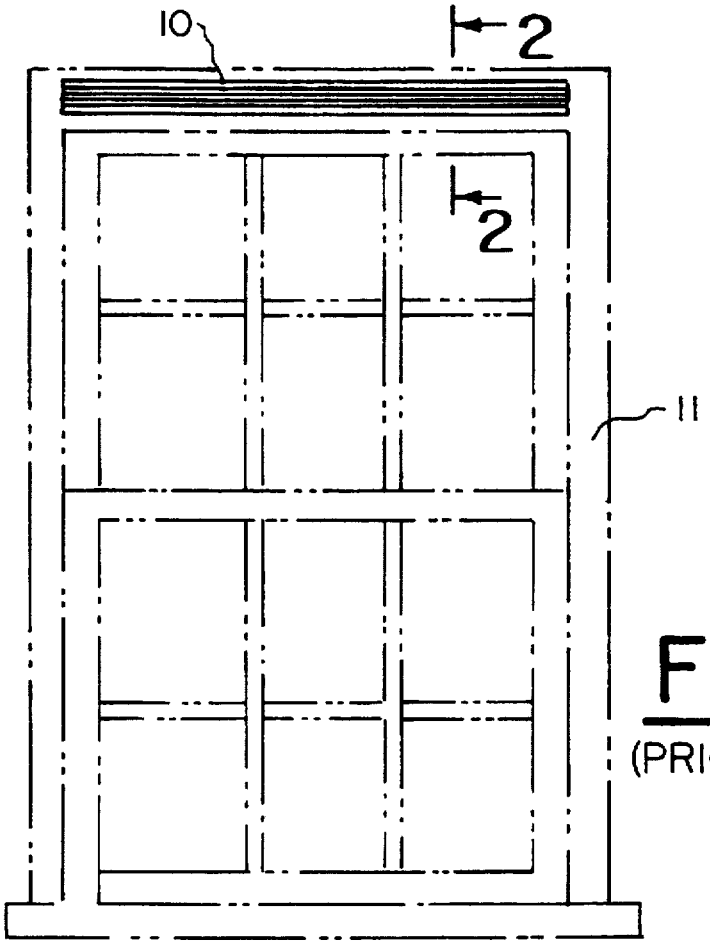
FIG. 1 (PRIOR ART)
FIG. 1 is an elevational view of a window showing a generic headbox attachment for a venetian blind.

Referring to FIG. 1, there is shown a generic headbox attachment 10 disposed over a venetian blind headboard mounted on a windowframe 11. Attachment 10 may be either a prior art attachment or an attachment in accordance with the present invention. The purpose of FIG. 1 is simply to show the arrangement of any venetian blind curtain-hanging attachment with respect to an opening in a wall such as a window. It should be noted that a headbox can be mounted on the inside upper portion as well.

Figure 2:
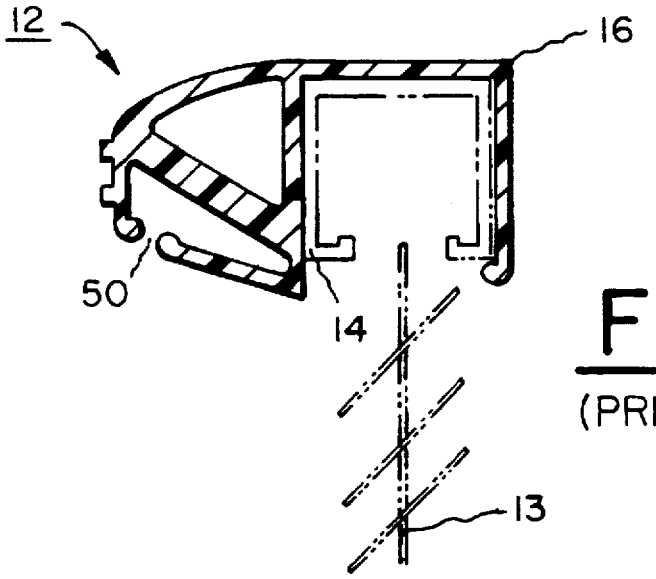
FIG. 2 (PRIOR ART)
FIG. 2 is a cross-sectional view, taken along line 2—2 in FIG. 1, of a headbox attachment attached to the headbox of a venetian blind as shown in my U.S. Pat. No. 5,520,235.
Figure 3:
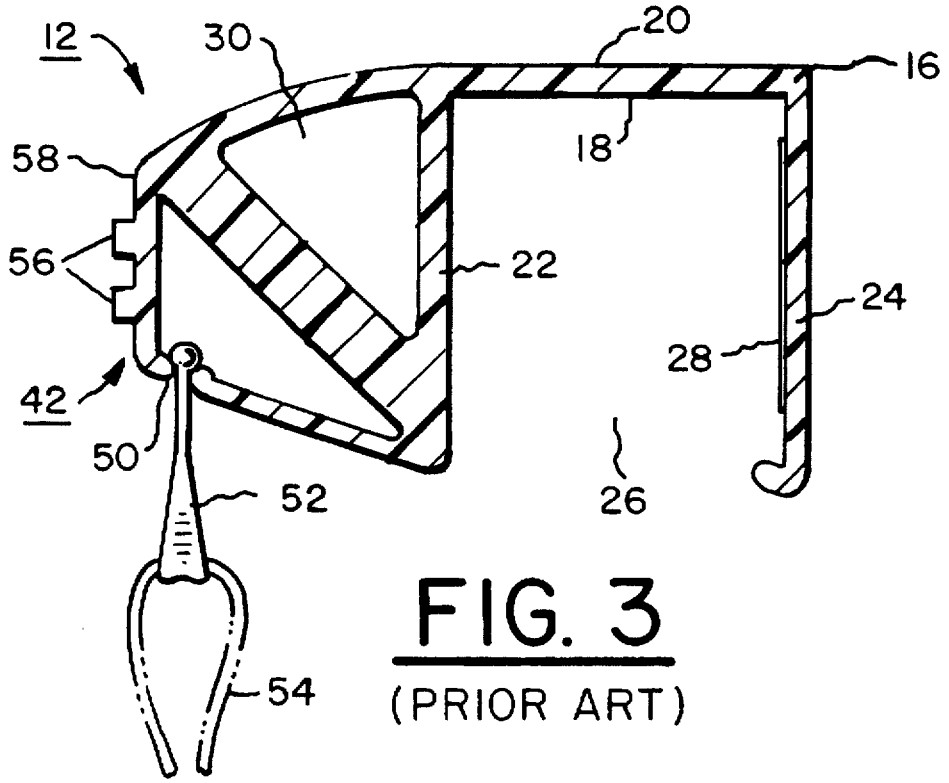
FIG. 3 (PRIOR ART)
FIG. 3 is a cross-sectional view of an attachment similar to that in FIG. 2, showing an adhesive strip for holding the headbox in the attachment, and showing the arrangement of a non-standard curtain hanger in a slot in the attachment.

A cross-section of the attachment 12 of my prior patent is shown in FIGS. 2 and 3, taken along line 2—2 in FIG. 1. Attachment 12 is shown containing a venetian blind 13 having a headbox 14. Blind 13 can be any width and height to accommodate the differing sizes of windows throughout a house. Attachment 12 contains a tail section 16 having an inner surface 18, an outer surface 20, a front wall 22, a back wall 24, and an open lower portion 26. An adhesive strip 28 couples with the inner surface of back wall 24 to retain the headbox 14 within the open lower portion 26 of attachment 12.

Attachment 12 has a formed passage 30, substantially triangular in cross-section, for receiving left and right end caps (not shown) having flanges for receiving a conventional curved metal curtain rod which can extend in front of the attachment. The end caps are mirror images of each other but are not interchangeable because the triangle is scalene and because one side of the formed passage 30 is curved.

Attachment 12 contains a hanger section 42 having a receiving slot 50 formed therethrough. Receiving slot 50 serves to receive non-standard curtain hangers 52 therein for hanging first curtains 54 therefrom, whereby curtains 54 may be drawn across the attachment.

Attachment 12 also contains two parallel raised ridges 56 integral with the outer surface 58 of attachment 12, which ridges can contain apertures for receiving snap-in hooks to hold second curtains 85 with rods in pockets. Such second curtains when hung on ridges 56 are fixed and may not be drawn across the attachment.

Figure 4:
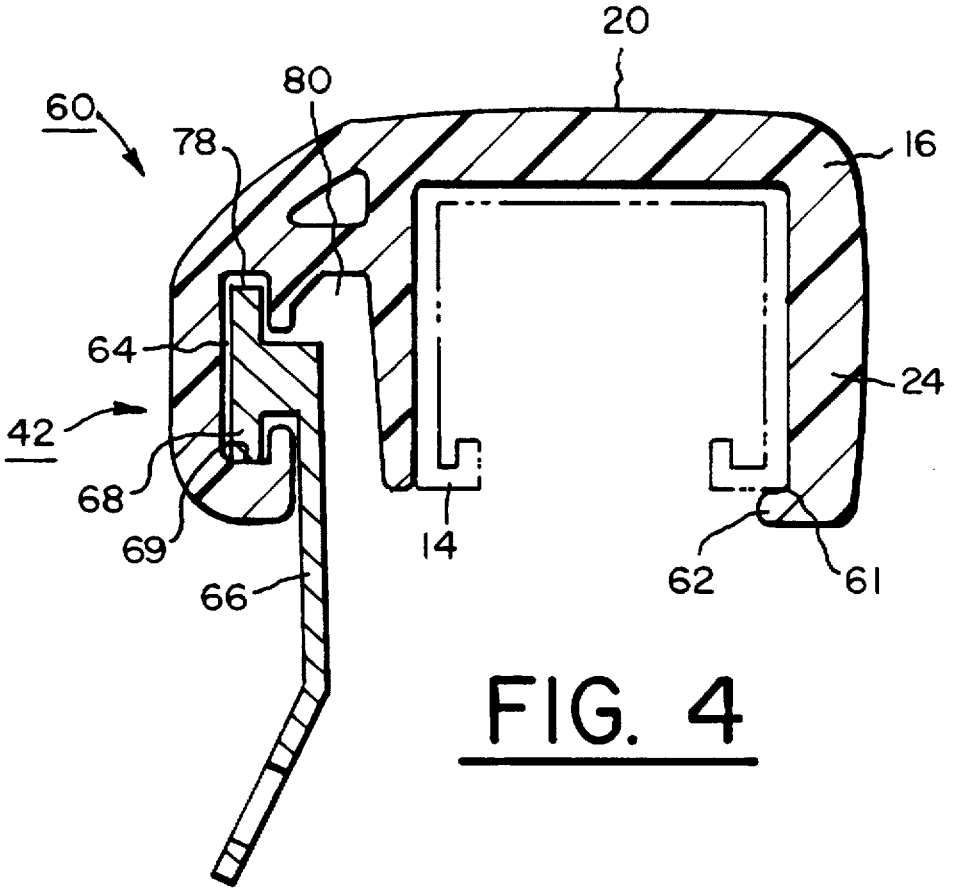
FIG. 4 is a cross-sectional view of a headbox attachment in accordance with the present invention.

A cross-sectional view of an improved attachment 60 in accordance with my present invention is shown in FIG. 4. Structural elements similar to those in prior art attachment 12 carry identical numbers. The attachment is part of an improved system for hanging curtains from a venetian blind headbox, as shown in subsequent FIGS. 5 through 8.

Figure 7:
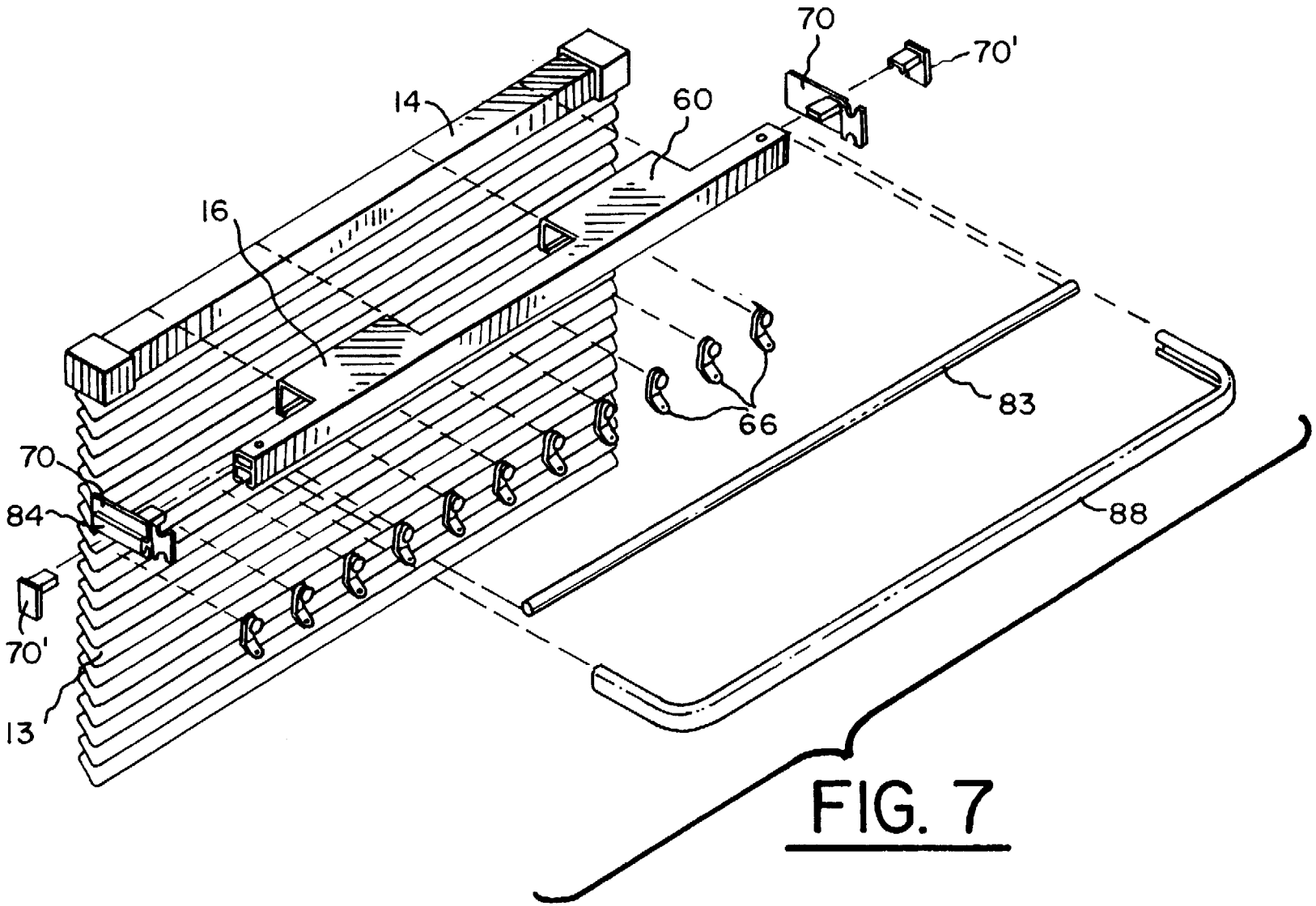
FIG. 7 is an exploded isometric view of a system for hanging curtains from a venetian blind headbox in accordance with the present invention.

A first improvement is that the attachment is substantially conformable to the headbox and that the height of back wall 24 in tail section 16 is selected to be substantially the same as the height of headbox 14, so that the headbox fits snugly within the attachment and is retained therein by engagement of a corner 61 of the headbox with lip 62. The attachment 60 can be flexible enough to be snapped over a mounted headbox, or the headbox can be dismounted and the attachment slipped onto it from an end. In either case, no adhesive layer is required to hold the attachment in place on the headbox. The attachment 60 may be injection molded from a plastic material. The tail section may be continuous over the length of the headbox or formed of a plurality of discrete sections as shown in FIG. 7 to clear headbox mounting hardware.

A second improvement is that the receiving slot 50 for hanging curtains 51 in hanger section 42 is reconfigured as an improved hanger section having a T-shaped slot 64, allowing use of standard curtain sliders 66 in place of non-standard hangers 52. The improved hanger section extends the entire length and preferably beyond the ends of the headbox a small distance as compared to the length of the headbox, e.g., less than one inch. The sliding flange 68 of slider 66 is fully captured within the T-slot, and the load is carried on the lower surface 69 of the slot. The slot opens to the rear, rather than downward as does slot 50 in the prior art attachment, and the slider is thereby captured more positively within its sliding channel, thus permitting the carrying of much heavier curtains or draperies than with the prior art configuration.

Figure 5:
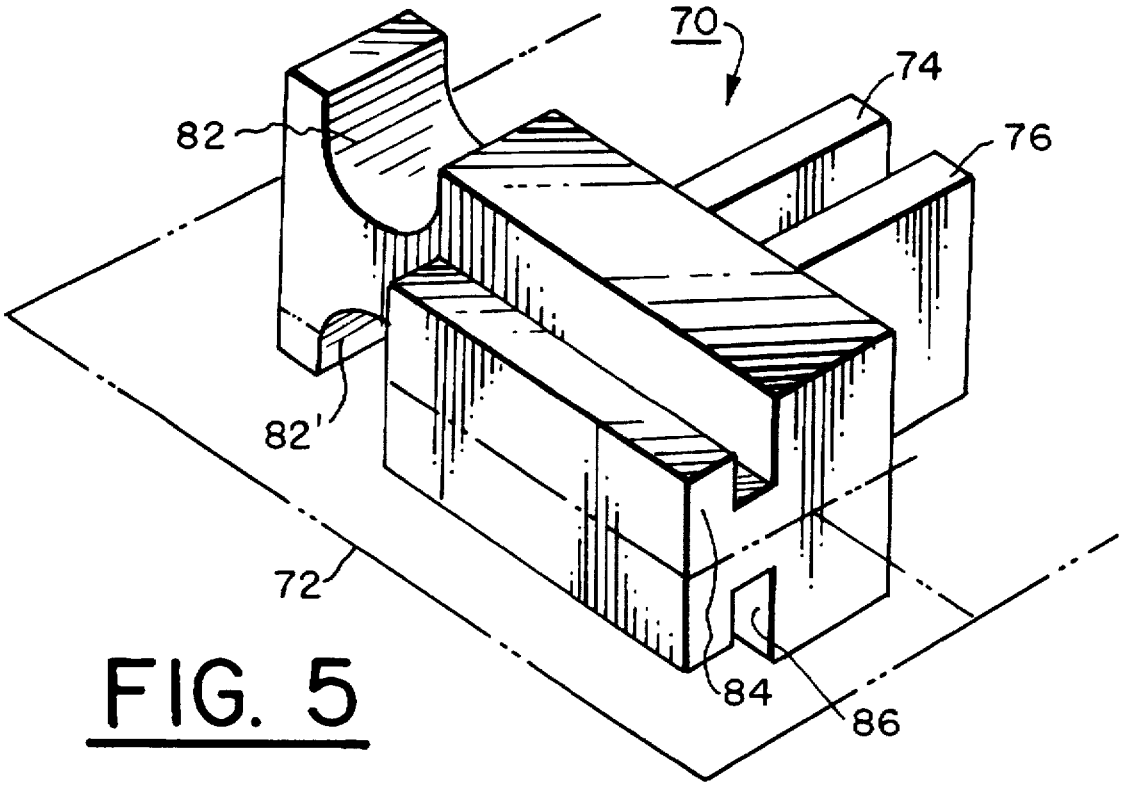
FIG. 5 is an isometric view of an endpiece for the headbox attachment shown in FIG. 4.
Figure 6:
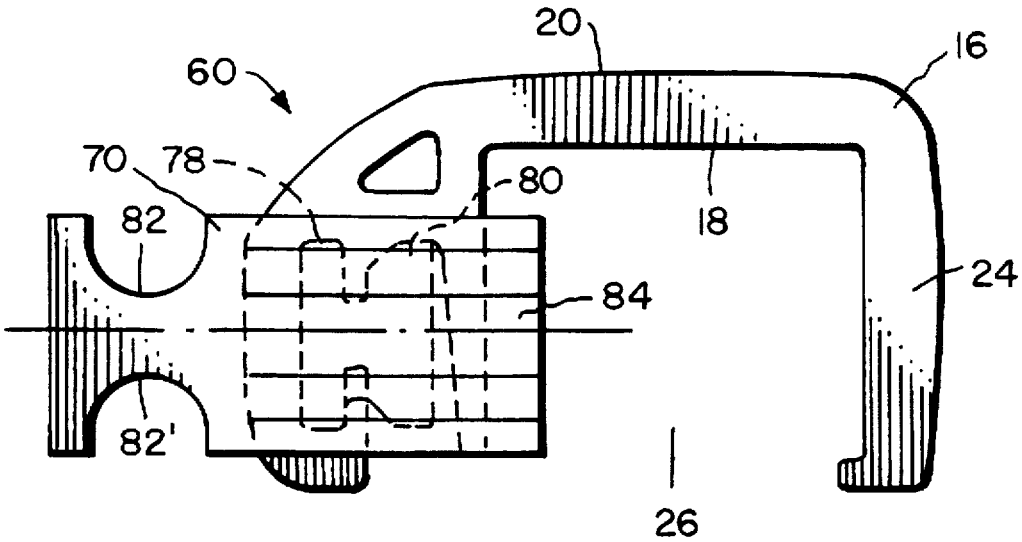
FIG. 6 is a cross-sectional view like that in FIG. 4, showing the endpiece of FIG. 5 in mated position within an end of a T-slot in the headbox attachment shown in FIG. 4.

A third improvement is that the end piece 70, shown isometrically in FIG. 5, can be formed with bilateral symmetry about plane 72 so that a single shape can fit into either end of attachment 60, as shown in FIG. 6, to close the end of the T-slot and thus retain curtain sliders 66 therein. A first flange 74 and second flange 76 fit snugly into the inner portion 78 and outer portion 80, respectively, of T-shaped slot 64. Of course, end pieces functionally identical with 70, fitting into portions 78 and 80, may be provided within the scope of the invention as non-symmetrical pieces of any desired configuration, for example for ornamental reasons, although this may require separate right and left pieces. Note also that the attachment 60 may be provided with a substantially rectilinear cross-section and a rectangular formed passage 30 to increase the beam strength of the attachment, and that the end pieces may be formed to be received by the ends of the formed passage 30 instead of or in addition to the T-shaped slot 64, such as is shown in FIG. 7

A fourth improvement is that end piece 70 may be provided with first and second saddles 82 and 82' for receiving a first curtain rod 83 for drawably hanging a second curtain 85 or set of curtains outside of first set 54 carried on sliders 66. Rod 83 is preferably formed from conventional straight tubular or solid cylindrical stock. This is an advantage over the hanger configuration of the prior art attachment 12 discussed above, wherein second curtains 85 are not drawable.

End piece 70 may also be provided with a known bayonet mount 84 on its outer surface 86 to receive a second curtain rod 88 for drawably hanging yet a third curtain 90 or set of curtains, for example a valence, outside of the first and second curtains 54 and 85, respectively. Second rod 88 is preferably a conventional metal curtain holder formed in the shape of a broad U. Of course, end piece 70 may also be provided in an alternative configuration 70' without saddles 82 and 82' and/or mount 84 where drawable second or third curtains are not required.

Figure 8:
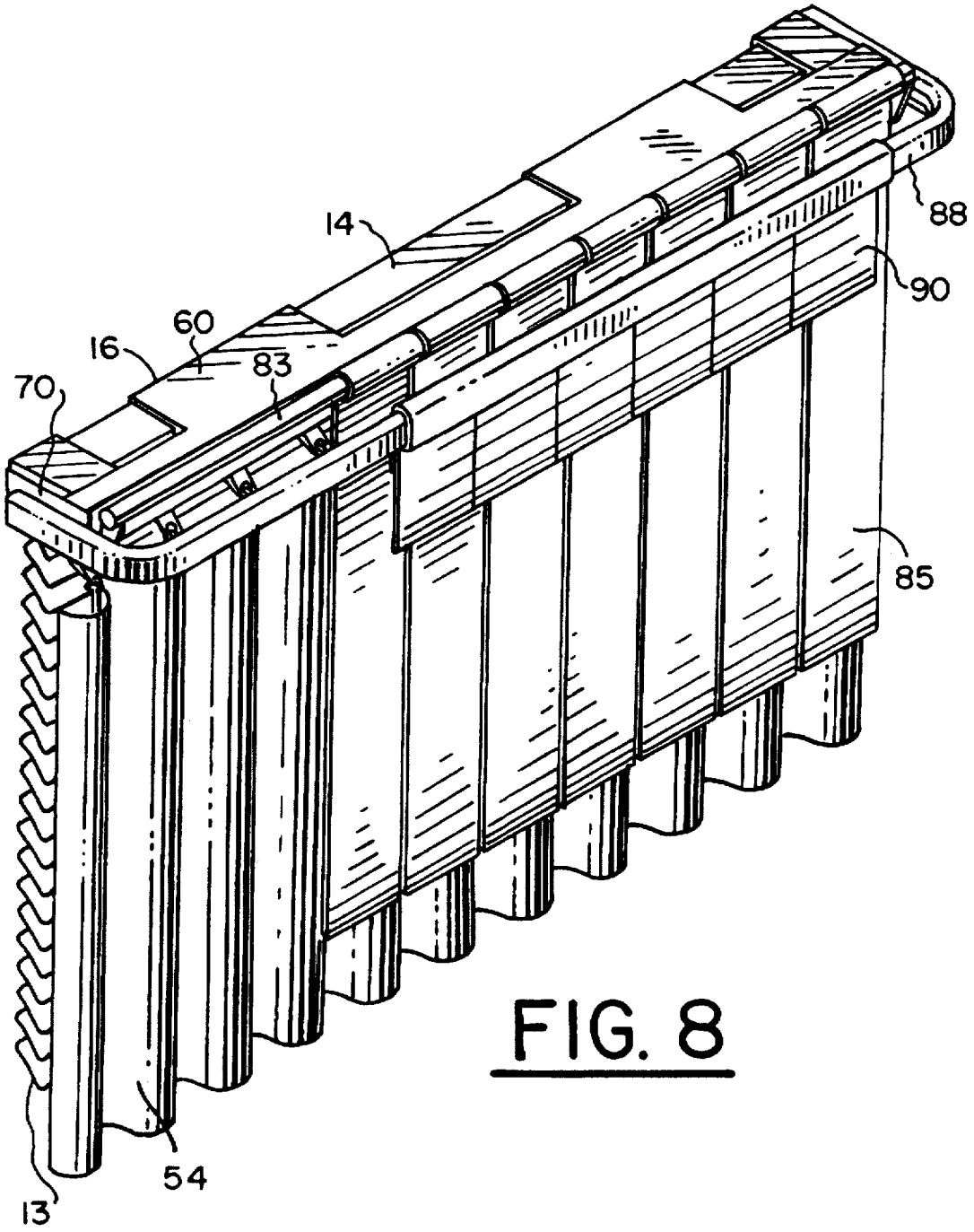
FIG. 8 is an assembled isometric view of the system shown in FIG. 7, showing its use with three drawable curtains.

A system in accordance with the invention is shown with all components in exploded form in FIG. 7, and in assembled form with all three sets of curtains in place in FIG. 8.

From the foregoing description it will be apparent that there has been provided an improved system for hanging a plurality of curtains, draperies, and valences, wherein no mounting hardware or adhesive strips are required to mount the system on a venetian blind headbox, and wherein up to three curtains may be individually and drawably hung. Variations and modifications of the herein described system, in accordance with the invention, will undoubtedly suggest themselves to those skilled in this art. Accordingly, the foregoing description should be taken as illustrative and not in a limiting sense.

What is claimed is:

1. System for hanging curtains comprising a venetian blind headbox mounted on a vertical surface a longitudinal tubular attachment having a tail section having a back wall of substantially the same height as the height of the headbox and having a longitudinal opening facing downwards for receiving the mounted venetian blind headbox therein, and a hanger section substantially co-extensive with the length of the headbox and having a longitudinal T-shaped slot for receiving one or more curtain sliders for handing a first curtain therefrom.

2. A system in accordance with claim 1 wherein said tail section further comprises a projecting lip at the lower edge of said inner wall for retaining said headbox in said attachment.

3. A system in accordance with claim 1 further comprising at least one removable end piece having at least one flange matable with an opening in said attachment to retain said end piece and said curtain sliders in said attachment.

4. A system in accordance with claim 3 wherein said T-shaped slot is included in the opening which retains said end piece.

5. A system in accordance with claim 3 wherein said end piece further comprises at least one saddle for supporting a first curtain rod.

6. A system in accordance with claim 3 wherein said end piece is alternately matable with either end of said endpiece-retaining opening in said attachment.

7. A system in accordance with claim 3 wherein said end piece is bilaterally symmetrical.

8. A system in accordance with claim 3 wherein said end piece further comprises a bayonet mount for receiving a second curtain rod.

9. A system in accordance with claim 1 wherein said attachment is a plastic molding.

10. A system for drawably hanging curtains, comprising a venetian blind headbox mountable on a wall and a tubular attachment mountable on said headbox, said attachment having a tail section having an inner wall of substantially the same height as the height of the headbox, and a hanger section extending essentially continuously the length of said headbox and having a longitudinal T-shaped slot for receiving one or more curtain sliders for drawably hanging a first curtain therefrom and openings which can include said T-shaped slot.

11. A system in accordance with claim 10 wherein said tail section further comprises a projecting lip at the lower edge of said inner wall for retaining said headbox in said attachment.

12. A system in accordance with claim 10 further comprising a pair of removable end pieces each having flanges matable with either end of said opening to retain said end pieces and said curtain sliders in said attachment, each of said end pieces having at least one saddle for supporting a first curtain rod for drawably hanging a second curtain therefrom and a bayonet mount for receiving a second curtain rod for drawably hanging a third curtain therefrom.

* * * * *